US009338841B2

(12) United States Patent
Leshniak

(10) Patent No.: US 9,338,841 B2
(45) Date of Patent: May 10, 2016

(54) LED DRIVER

(71) Applicant: Amerlux LLC, Fairfield, NJ (US)

(72) Inventor: Itai Leshniak, Fair Lawn, NJ (US)

(73) Assignee: AMERLUX LLC, Fairfield, NJ (US)

( * ) Notice: Subject to any disclaimer, the term of this patent is extended or adjusted under 35 U.S.C. 154(b) by 0 days.

(21) Appl. No.: 14/044,492

(22) Filed: Oct. 2, 2013

(65) Prior Publication Data

US 2014/0028191 A1 Jan. 30, 2014

Related U.S. Application Data

(63) Continuation of application No. PCT/US2012/043296, filed on Jun. 20, 2012.

(60) Provisional application No. 61/499,167, filed on Jun. 20, 2011, provisional application No. 61/565,855, filed on Dec. 1, 2011.

(51) Int. Cl.
*H05B 37/02* (2006.01)
*H05B 33/08* (2006.01)

(52) U.S. Cl.
CPC ..... *H05B 33/0815* (2013.01); *H05B 33/0848* (2013.01)

(58) Field of Classification Search
USPC ..... 315/291, 307, 312, 200 R, 209 R
See application file for complete search history.

(56) References Cited

U.S. PATENT DOCUMENTS

| | | | | |
|---|---|---|---|---|
| 6,011,357 | A * | 1/2000 | Gradzki et al. | 315/224 |
| 6,175,195 | B1 * | 1/2001 | Janczak et al. | 315/194 |
| 7,733,034 | B2 | 6/2010 | Kotikalapoodi et al. | |
| 7,804,256 | B2 | 9/2010 | Melanson | |
| 7,821,237 | B2 | 10/2010 | Melanson | |
| 2008/0123340 | A1 * | 5/2008 | McClellan | 362/294 |
| 2009/0016045 | A1 | 1/2009 | Medinis | |
| 2009/0039799 | A1 | 2/2009 | Newman, Jr. et al. | |
| 2010/0045193 | A1 * | 2/2010 | Konishi et al. | 315/185 R |

(Continued)

FOREIGN PATENT DOCUMENTS

| | | | |
|---|---|---|---|
| RU | 71729 | U1 | 3/2008 |
| WO | 2010/068641 | A1 | 6/2010 |
| WO | 2010068641 | A1 | 6/2010 |

OTHER PUBLICATIONS

International Search Report in corresponding international application PCT/US2012/043296, mailed Sep. 20, 2012.

International Search Report for related international application No. PCT/US2012/043296, mailed Sep. 20, 2012.

(Continued)

*Primary Examiner* — Minh D A
(74) *Attorney, Agent, or Firm* — Day Pitney LLP

(57) ABSTRACT

Lighting systems are disclosed, including a multi-die LED array; and LED driver electronics, which include voltage regulating electronics which regulate rectified low voltage AC. The voltage regulating electronics include: booster electronics that sense rectified low voltage AC and boost the LVAC to a predetermined voltage for powering the multi-die LED; power factor correcting electronics that sense the AC current and AC voltage in the driver and control the booster electronics to further regulate the voltage, thereby providing power factor correction; and constant current electronics which sense one or both of current and voltage through the driver and control the booster electronics to further regulate the voltage, thereby providing substantially constant current to the multi-die LED array.

16 Claims, 12 Drawing Sheets

(56) References Cited

U.S. PATENT DOCUMENTS

2011/0080112 A1* 4/2011 Shearer et al. ..... 315/291
2011/0227489 A1* 9/2011 Huynh ..... 315/185 R

OTHER PUBLICATIONS

International Preliminary Report on Patentability and Written Opinion for related international application No. PCT/US2012/043296, mailed Sep. 20, 2012.

* cited by examiner

LED DRIVER

CROSS REFERENCE TO RELATED APPLICATIONS

This application is a continuation of International Application Number PCT/US2012/043296, filed Jun. 20, 2012, which claims priority to U.S. Provisional Application No. 61/499,167, filed on Jun. 20, 2011 and U.S. Provisional Application No. 61/565,855, filed on Dec. 1, 2011. Each of the foregoing patent applications is incorporated by reference in its entirety for any purpose whatsoever.

BACKGROUND

1. Field of the Disclosed Embodiments

The disclosed embodiments relate to Light Emitting Diode ("LED") drivers using low voltage power corrected input that deliver low voltage direct current ("de"), at substantially constant current.

2. Background of the Related Art

Low voltage AC tracks are desirable because the tracks are easy to install and are safe to touch. The benefits are easy to appreciate for "do-it-yourself" type individuals and are suitable for installation in low lying areas such as residential gardens where children and pets play. Low voltage halogen fixtures which are typically powered by these low voltage tracks have challenges. The halogen bulbs are relatively expensive, have short life spans and are relatively hot. The industry desires LED fixtures for placement in the low voltage tracks which have extremely long life spans, are not nearly as hot when properly powered and are more energy efficient.

Challenges to be overcome with LED lighting include that each diode in an LED array configuration, as can be found in a single fixture, requires three to four volts-DC ("VDC") to light. Thus, a multi-die LED array on one fixture can quickly exceed the supplied low voltage, preventing power from flowing through the LED array. In addition, LEDs can burn out if exposed to current in excess of their rated current. Moreover, if dimming is desired, reducing the available voltage can cause LED flicker.

On the other hand, power factor correcting has become a concern of consumer side usage. Power factor correcting is widely used in offline power supplies and drivers for 120V and up. When using standard incandescent light, the power factor is always 100%, but this is not the case with LEDs.

New power regulations, like Energy Star, are demanding power factors over 90%. A reduced power factor is sensed when a power company's transformers become overloaded due to mismatching electrical characteristics at the consumer side load. Specifically, the phase difference between voltage sensed at the consumer side as compared with current absorbed by the consumer side load is mismatched. Such mismatching causes an improper electrical pull on the supply side.

A power company charges commercial consumers for resulting losses, though regulations prohibit a power company from directly charging residential consumers. Nonetheless, power losses result in an increased in cost for all consumers, both residential and commercial.

BRIEF SUMMARY OF THE DISCLOSED EMBODIMENTS

Lighting systems are disclosed, including in some embodiments a multi-die LED array and associated LED driver electronics. The driver electronics include voltage regulating electronics, which regulate rectified low voltage AC. The voltage regulating electronics include booster electronics that sense rectified low voltage AC and boost the LVAC to a predetermined voltage for powering the multi-die LED. The voltage regulating electronics can further include power factor correcting electronics that sense the AC current and AC voltage in the driver and can control the booster electronics to further regulate the voltage, thereby providing power factor correction. In addition, the voltage regulating electronics include constant current electronics which sense one or both of current and voltage through the driver and control the booster electronics to further regulate the voltage, thereby providing substantially constant current to the multi-die LED array.

DESCRIPTION OF THE FIGURES

The disclosed embodiments are illustrated in the accompanying figures, which are not limiting, and in which.

DETAILED DESCRIPTION OF THE DISCLOSED EMBODIMENTS

Novel usages of low voltage drivers will be provided before focusing on the driver itself. FIGS. 1-5 illustrate an exemplary low voltage DC (LVDC), current limited LED fixture 10 with power factor correction, adapted for being retrofitted in low voltage halogen fixtures. A low voltage coupling/track adaptor (top) 12 is connected to a power driver housing arm/ballast box (side) 14. The ballast box 14 is pivotally connected to an LED receptacle 16, which includes a heat sink 18 extending upwardly therefrom. The coupling (top) 12 is a track adaptor for a low voltage system, such as which typically receives an MR 16 halogen bulb. The LVDC LED fixture 10 is stylized to conform to the style of a typically installed MR 16 halogen receptacle fixture.

Figure 1:
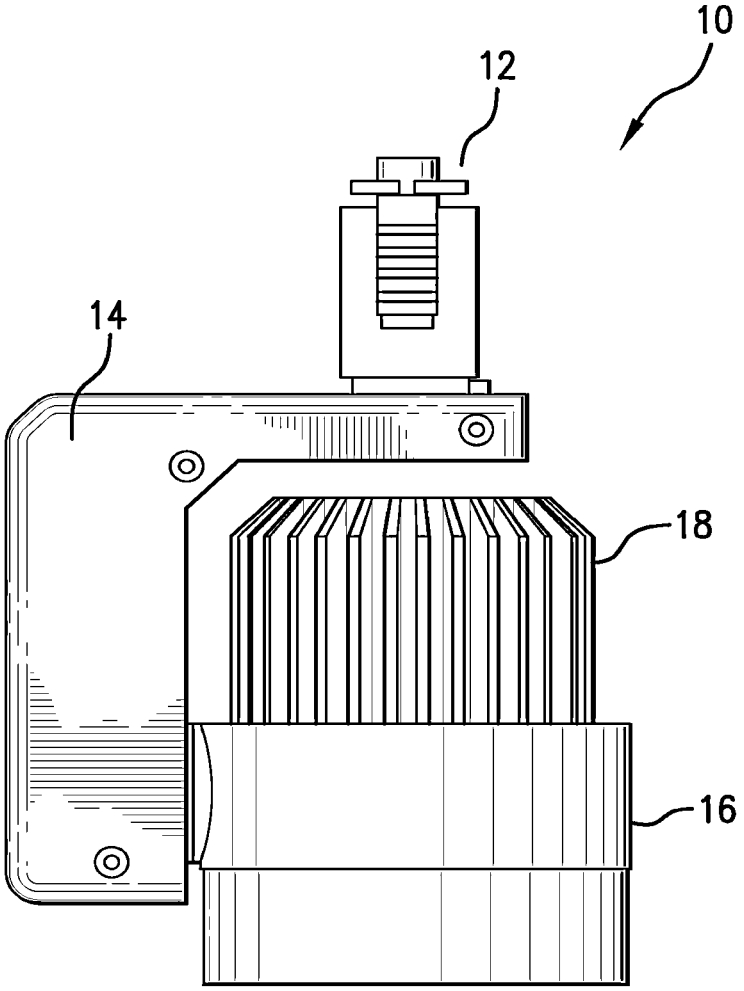
FIG. 1 illustrates a front view of an exemplary low voltage DC LVDC) LED fixture.
Figure 2:
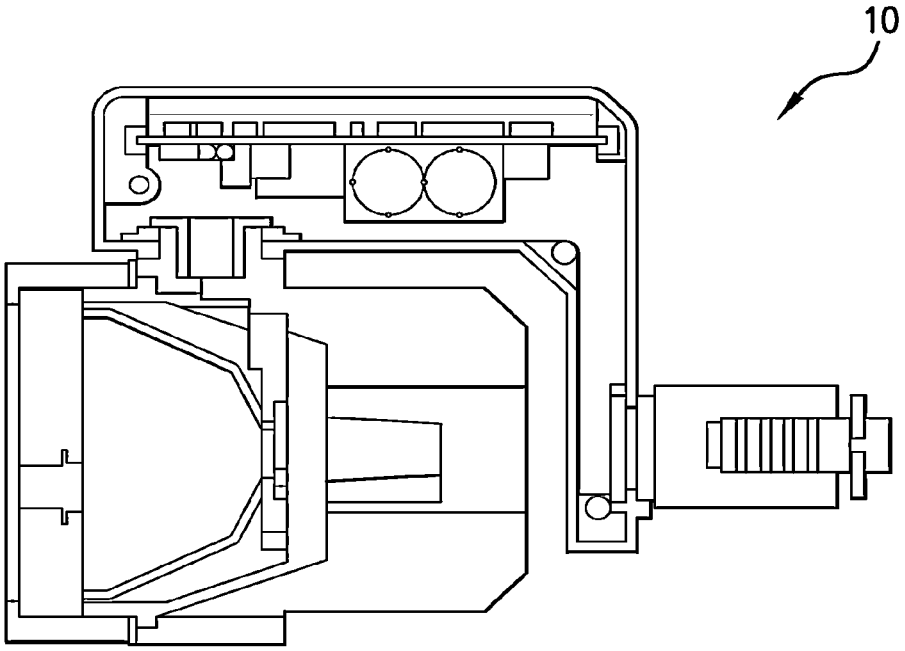
FIG. 2 illustrates a cross sectional view thereof.
Figure 3:
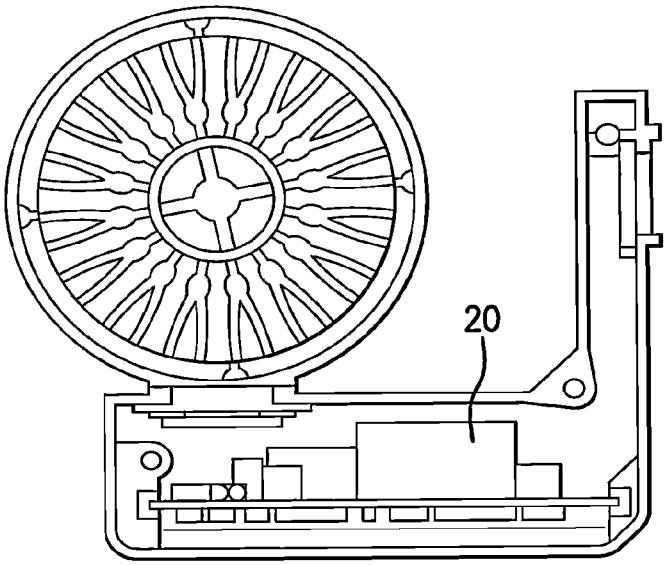
FIG. 3 illustrates another cross sectional view thereof, with the LED head rotated 90 degrees, and the track adaptor not installed.
Figure 4:
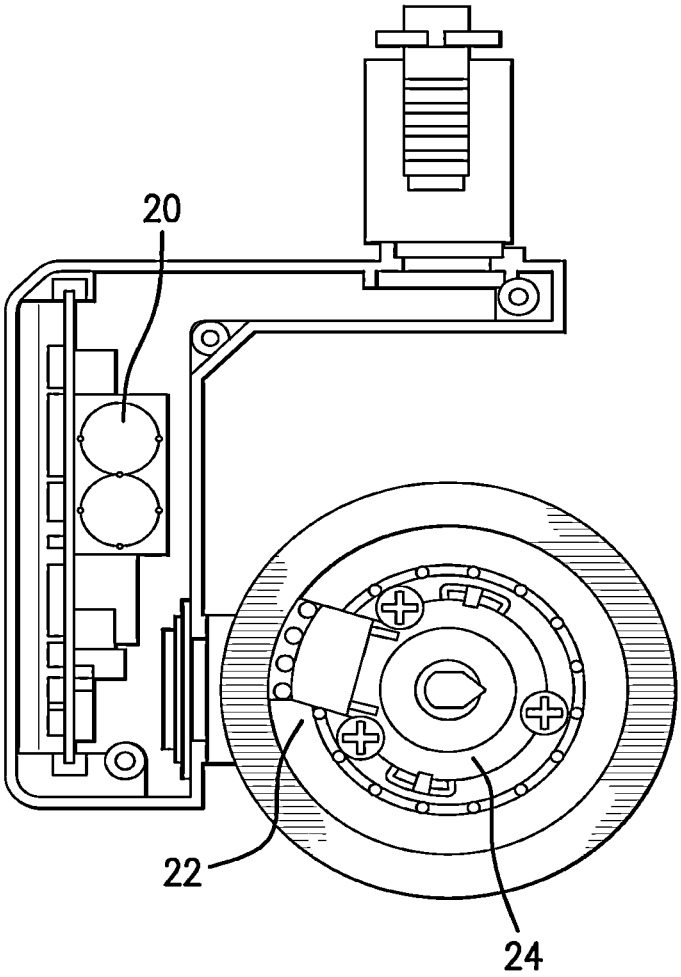
FIG. 4 illustrates the view of FIG. 3 with an LED array installed in the fixture and the track adaptor installed.
Figure 5:
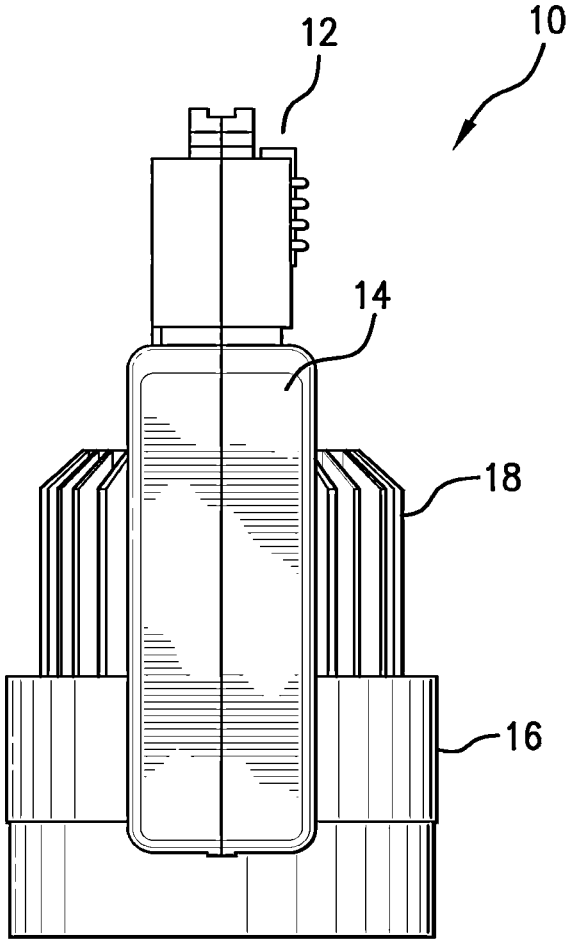
FIG. 5 illustrates a side view of the LVDC LED fixture.

Turning to FIGS. 2-4, the driver housing arm 14 and receptacle 16 are illustrated in a cross section to expose the driver electronics 20, discussed below in detail. Also exposed are typical LED connector electronics and components 22. As indicated, the LED array 24 intended for installation into the receptacle 16 comprises a multi-die LED array on one printed circuit board ("PCB"). Such LED array can produce over 800 lumens at 15 Watts ("W") for more than fifty thousand hours. This is a significant improvement to an MR 16 halogen bulb, which produces approximately 500 lumens at 35 W, up to 900 lumens at 50 W for three thousand hours, at best. The LED array can be, as an example, a LUXEON "S" package by Philips Lumileds Lighting, containing multiple LED dies which are arranged to function as a single light source.

Figure 6:
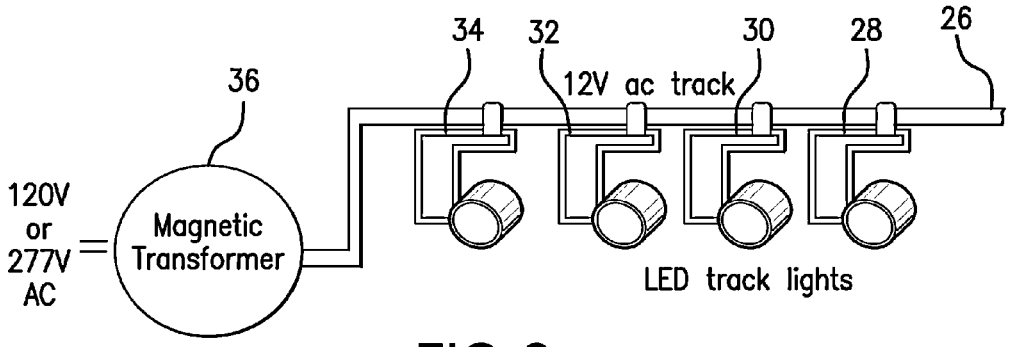
FIG. 6 is an illustration of a LVAC track with plural LVDC LED fixtures.

FIG. 6 is an illustration of an exemplary low voltage AC (LVAC) track 26 with plural LVAC fixtures 28-34, all of which are essentially the same as fixture 10, and are connected in parallel along the track 26. The track is designed to deliver low voltage power from a standard magnetic (or electronic) transformer 36 providing 300 W (or any size). The transformer receives 120V or 277V AC (or any line voltage, e.g., 220V in the case of the EU) and converts the line voltage to low 12V AC or 12 LVAC.

Figure 7:
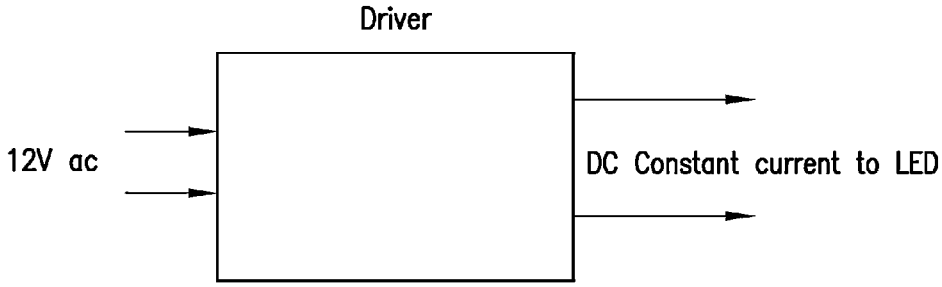
FIG. 7 illustrates an overview of the driver function.

Broadly speaking, as illustrated in FIG. 7, operational parameters of the disclosed driver 20 in the ballast box 14 include receiving 12 VAC (low voltage, safe to touch) and delivering boosted LVDC to an LED array installed in an LED fixture. Boosted LVDC will enable powering several LED dies on the LED array installed in the fixture. Boosting also enables utilizing a broad range of dimming capabilities, that is, using a standard dimmer positioned upstream of the low voltage transformer, without causing LED flicker at low power.

On the other hand, the operational parameter of providing constant current assures that power drawn by the LEDs will not burn out the load. The operational parameters of the driver 20 provide that the appropriate amount of constant current will be provided to the LEDs regardless of LED voltage variation, supply voltage variation, or other circuit parameters that could otherwise affect LED current.

As indicated, power factor correction is also an operational parameter of the disclosed driver. Existing LED drivers that use low voltage input do not have power factor correction. Though, as indicated, there is more available power for the above illustrated 120V or 277V to 12 VAC transformer with power factor corrected load, and better use of available power is better for the environment.

Figure 8:
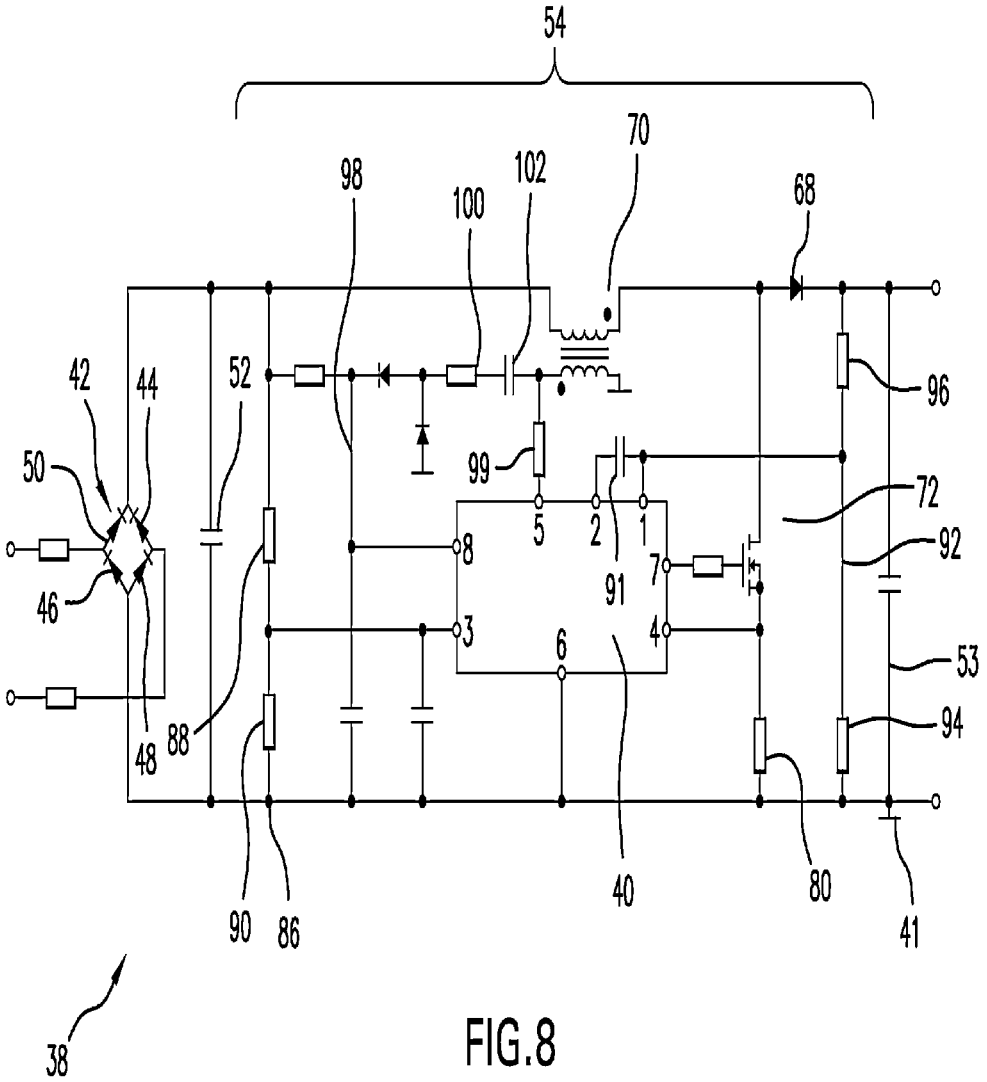
FIG. 8 is an overview of a driver configuration which does not provide current regulation.

For reference, FIG. 8 illustrates an overview of a driver with voltage regulating electronics 54 for delivering boosted LVDC at substantially constant current with power factor correction. The center of the voltage regulating electronics 54 is an eight pin, L6561 microcontroller 40. FIG. 8 corresponds with FIG. 6 from "http://www.st.com/internet/com/TECHNICAL_RESOURCES/TECHNICAL_LITERATURE/DATASHEET/CD00 001174.pdf", from ST Microelectronics, 354 Veterans Memorial Highway, Commack, N.Y., USA, which is incorporated by reference herein in its entirety. FIG. 8 corresponds with the 80 W/110 VAC transformer configuration for an L6561 controller with power factor correcting electronics.

For reference, GND Pin 6 (see also FIG. 10 herein for Pin number references) is connected to the driver common ground 41. Clockwise from GND Pin 6, the pin configuration for the controller is: MULT Pin 3, which is the input of a multiplier stage; Vcc Pin 8, which the supply voltage of driver and control circuits (which requires about 15 VDC); ZCD Pin 5, which is a zero current detection input; COMP Pin 2, which is an output of an error amplifier; INV Pin 1, which is an inverting input of an error amplifier; GD Pin 7, which is a gate driver output; and CS Pin 4, which is an input to a comparator of a control loop. The use of these pins is referenced below but also well known and provided in the stated specification.

The topology 38 in FIG. 8 includes an input of 12 VAC, which passes through full rectifying electronics 42. The rectifying electronics 42 include a diode bridge consisting of four diodes 44-50. As an alternative, disclosed below and illustrated in FIG. 11, the rectifying electronics can include plural diodes arranged in parallel to conserve space on a small PCB.

The rectified AC output is passed through filtering/voltage smoothing electronics 52, which is illustrated as a capacitor branch which is parallel to the rectified output. On the output side, the driver includes an output voltage flattening filter 53 as well which is a capacitor branch disposed in parallel with the load branch (load illustrated in FIG. 10).

The output filter 53 is much larger than the input filter 52 and substantially flattens the voltage to provide a substantially flattened DC output from the LVAC, which is optimal for the multi-die LED array. It can be appreciated by a skilled artisan that correcting the power factor requires oscillating current and voltage. Thus, the power factor is corrected before flattening the voltage curve.

The rectified and filtered LVAC input is passed through the voltage regulating electronics 54. As illustrated, the center of the voltage regulating electronics 54 includes the L6561 microchip 40.

Voltage in the rectified mains is sensed by the voltage regulating electronics 54 via MULT Pin 3 through a resistive divider branch 86, which includes a pair of resistors 88, 90, and which is parallel with the filter branch. Driver output voltage is sensed via a resistive divider branch 92 connected to Inv Pin 1 and Comp Pin 2 via a filtering capacitor branch 91, which creates an error feedback loop. The output side voltage divider branch 92 includes first and second resistors 94, 96 connected in parallel with the output filter branch 53.

Figure 9:
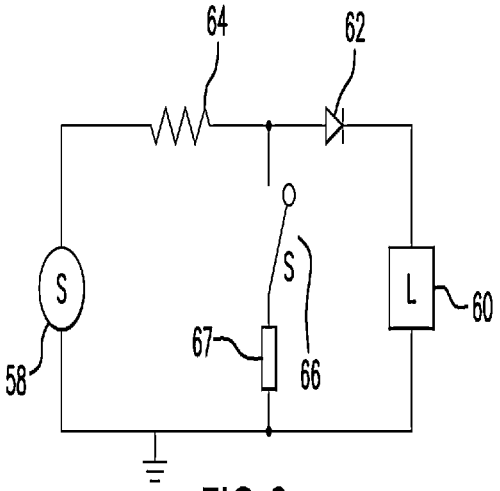
FIG. 9 illustrates simplified booster electronics.

Regarding the boosting electronics in the driver, a simplistic illustration of booster electronics 56 is provided in FIG. 9. The circuit includes a supply 58, which includes the supply of LVAC, a load 60, which for purposes of the present application is a multi-die LED array, a rectifying diode 62 in series with the load, an inductor 64 in series with the supply, and a switch branch 66, which includes a resistor 67, connecting in parallel the supply/inductor loop with the diode/load loop.

With the disclosed illustrative booster configuration, the minimum load voltage must be the same as or greater than the peak line voltage. For example, with the line providing 12 VAC (rms), the line peak is closer to 17V. With, for example, nine LED dies on an LED array on the load side, at about 3V for each LED, the load side voltage draw is well above the peak input voltage. Thus, the booster operates to raise line voltage to a feasible level.

The fundamentals of the boosting process are as follows. The inductor builds voltage when there is a change in current. The switch closes the line, allowing current to flow to the ground through a resister, which is a path of least resistance compared with the LED load. Once the switch is closed, current will build to a predetermined amount through the resistor, which is measured, and which corresponds to a predetermined boost in voltage at the inductor. At the proper boost, the switch is opened and the boosted voltage will power the multi-die LED array.

Turning back to FIG. 8, the simplified booster electronics can be mapped to the voltage regulating electronics 54. Specifically, such electronics can include: the diode branch 68; the inductor branch 70; and the microchip controlled power FET switch 72 branch, which includes the resistor 80 disposed on the source side of the switch 72, through which CS Pin 4 is able to sense and measure current. The FET drain is directed away from the common ground 41. The gate of the switch 72 is connected to and controlled via GD Pin 7 of the controller 40.

The basis of the power factor correction in the electronics in FIG. 8 is the controller sensing the phase difference between AC current and AC voltage based on the illustrated connections. The controller controls the booster electronics according to design functionality, controlling the phase of the current though the driver. This minimizes the phase difference, providing power factor correction.

For delivering a constant current, the controller 40 senses current and voltage through the above connections. If the average current sensed is X Amps, and the current is supposed to be Y Amps, the controller controls the disclosed booster electronics, that is, the switch, to modify output voltage and provide the desired average current. For example, because resistance remains constant through the resistor at CS Pin 4, modifying the current results in a modified voltage sensed at CS Pin 4.

Power to the controller 40 is provided to Vcc Pin 8 via a branch 98 magnetically coupled to the inductor 70, which is also connected to the ZCD Pin 5. Various electronics are provided on branch 98, including a resistor 100 and capacitor 102. Branch 98 includes an additional downstream filtering capacitor, connected near the ground, for providing desired electrical timing and filtering characteristics. ZCD Pin 5 senses current through a resistor branch 99 for periodically disabling the microcontroller during discharge of the inductor, to prevent overcharging. Further, GND Pin 6 is grounded to the common driver ground 41.

The circuit 38 illustrated in FIG. 8 is for boosting 120V input to 240V output. As can be appreciated, it is not intended for use in a low voltage environment of the type needed for driving LEDs. However, such a novel implementation, configured as disclosed below, is capable of powering an LED array.

Figure 10:
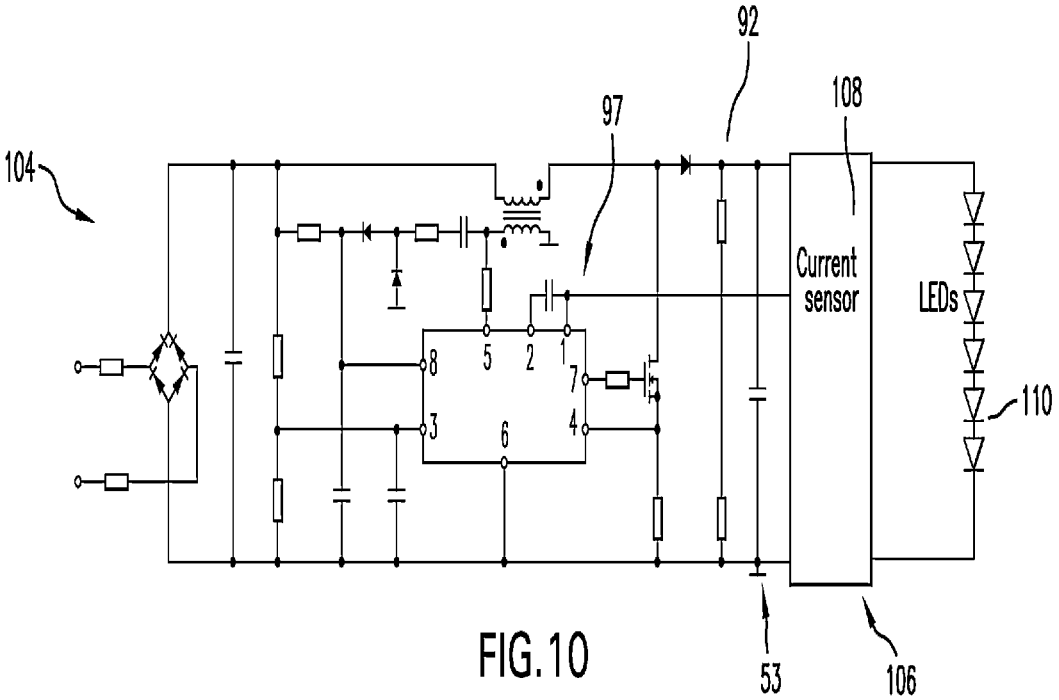
FIG. 10 illustrates the electronics of FIG. 8 equipped with current regulating electronics.

Turning to FIG. 10, a circuit 104 is illustrated which is a novel modification to the circuit 38 of FIG. 8. Circuit 104 is illustrated with current sensing technology 106 in feedback with the same voltage regulating electronics 54 illustrated in FIG. 8. The current regulating technology 106 includes a current sensor 108 illustrated between the load branch 110 and the load side filter branch 53.

The current sensor 108 provides additional feedback to the feedback loop 97 via a connection with the resistive divider 92. This connection enables manipulating driver output voltage to assure that current remains essentially constant regardless of load voltage.

Figure 11:
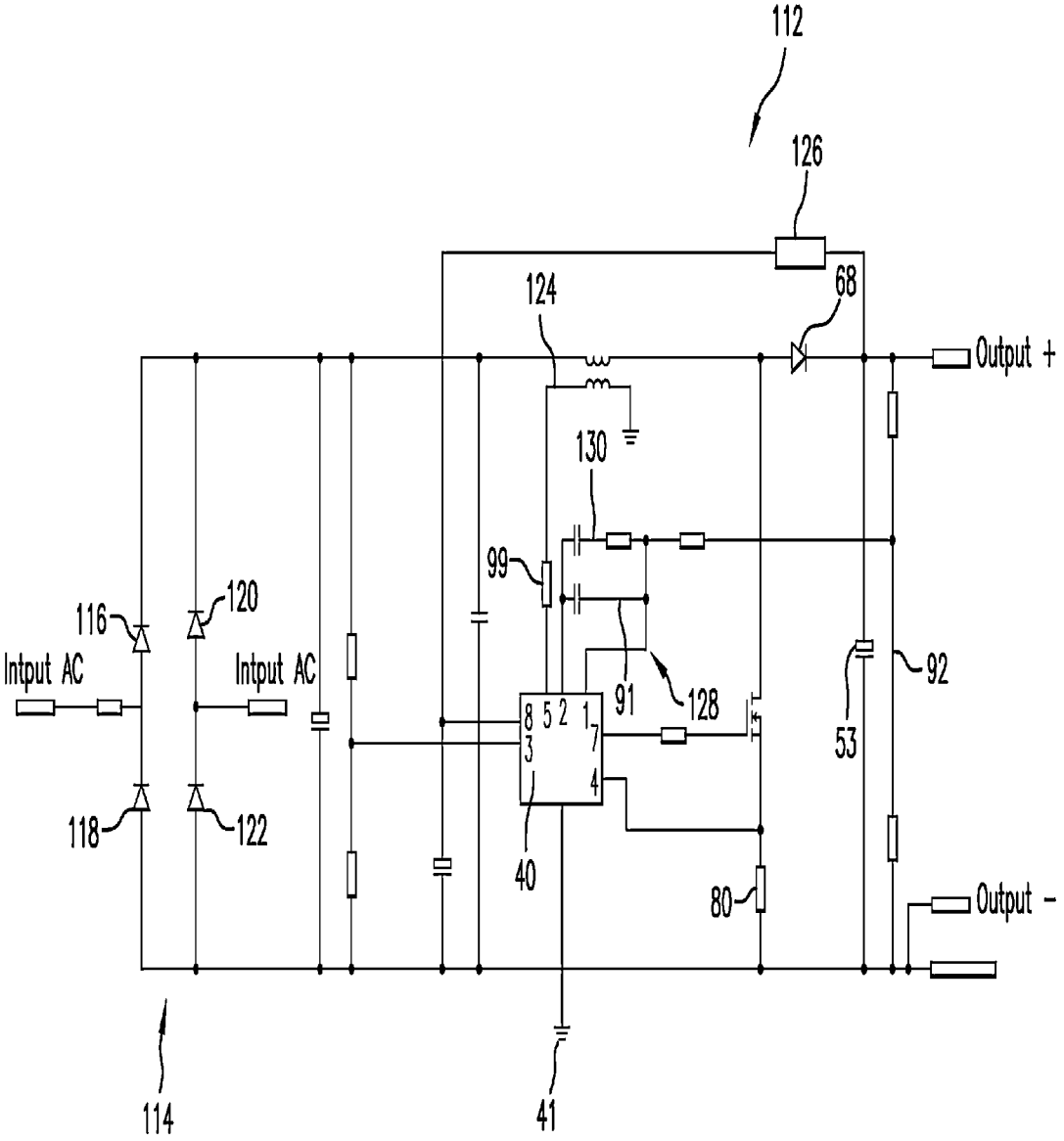
FIG. 11 illustrates an implementation for achieving the functional characteristics in FIG. 8.

Turning to FIG. 11, another novel modified version of the driver circuit of FIG. 8 is illustrated. This configuration delivers boosted, power factor corrected, LVDC to a multi-die LED array. This configuration is well suited for low voltage applications.

In comparison with FIG. 8, the rectifying circuitry 114 can include two pair of diodes 116, 118, 120, 122 disposed on two parallel branches for reasons mentioned above. In this embodiment, the grounded zero crossing branch 124, magnetically connected to the boosted main, includes the resistor 99 connected to ZCD Pin 5. However, the grounded zero crossing branch 124 does not connect to Vcc Pin 8 for powering the processor 40. Instead, boosted power, which has been filtered by the downstream filter branch 53, passes through a linear voltage regulator 126.

The regulator 126 regulates the boosted voltage to a lower amount for powering the controller 40. For example, the boosted mains may have 20-30 VDC, while the controller 40 only requires 15 VDC to operate. Using this type of voltage regulator 126 would be less acceptable for the implementation in the ST specification (FIG. 8), which directs use of the driver circuit in a 110 VAC environment. However, with a peak boosted voltage of 20-30 VDC, the configuration in FIG. 11 is acceptable.

As compared with the error feedback loop 97 of FIG. 8, the error feedback loop 128 illustrated in FIG. 11 is that in illustrated in the ST electronics L6561 specification document, identified above, as FIG. 9 thereof. That figure in the L6561 specification document teaches a configuration for a boost indicator spec. The error feedback loop 128 includes, in addition to the capacitor branch 91, a resistor/capacitor branch 130 parallel with the capacitor branch 91. Such configuration of the feedback loop 128 provides for an additional ability to modify the phase and timing of the feedback filtering characteristics, as would be appreciated by one of ordinary skill. However neither feedback configuration 97 (FIGS. 8 and 10), 128 (FIG. 11) is limiting to the scope of the disclosed embodiments.

Moreover, in FIG. 11, a resistor branch 130 connects the error feedback loop 128 to the resistive divider branch 92. The resister enables the feedback of sensed current, in addition to voltage, the latter of which does not require resister 130.

In addition, as compared with the embodiment in FIG. 8, the downstream voltage resistor branch 92 and capacitor branch 53 in FIG. 11 are swapped. However, with the same voltage drop across each parallel branch, this modification is semantics.

Figure 12:
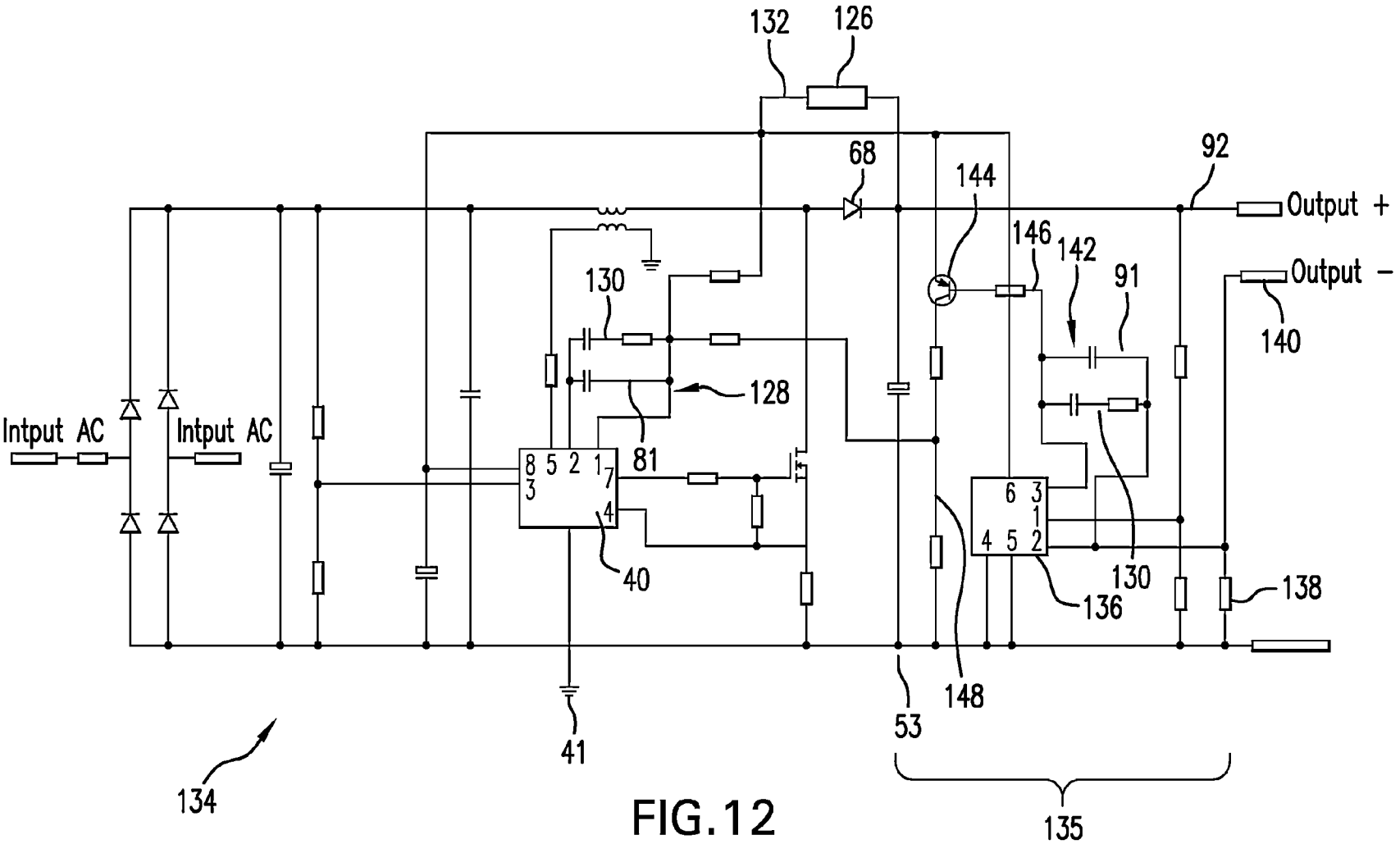
FIG. 12 illustrates another implementation for achieving the functional characteristics in FIG. 10.

In FIG. 12, the illustrated circuit 134 is a modification of the embodiments of FIG. 10 and FIG. 11. This configuration utilizes additional circuitry for assuring that constant current is delivered to the multi-die LED array. For example, in this circuit 134, additional current and voltage sensing circuitry 135 is provided on the driver the output side. This additional circuitry 135 includes an additional microcontroller 136 and related circuitry.

It will be appreciated that sensing circuitry 135 in FIG. 12 broadly corresponds to and is inclusive of current sensing circuitry 106 in FIG. 10. Moreover, current sensing components of the sensing circuitry 135, disclosed below, correspond to current sensor 108 in FIG. 10.

More specifically, the sensing circuitry 135 is provided between the voltage divider 92 and capacitor branch 53 illustrated in FIG. 12. The sensing circuitry 135 is tied into the feedback loop 128. This provides for controlling, in part, the voltage modifying function of the regulating controller 40 for providing substantially constant current.

The sensing controller 136 is a TSM1052 constant voltage and constant current controller from ST Microelectronics. For reference, the Vcc Pin 6 illustrated in top dead center is the supply voltage for the controller. Clockwise from Vcc Pin 6, the pin configuration of the controller is: OUT Pin 3, which is a common open-drain output of two internal op-amps; V-CTRL Pin 1, which is the inverting input of a voltage loop op amp; V-SENSE Pin 5, which is the inverting output of a current loop op amp; GND Pin 2 (ground); and I-CTRL Pin 4, which is the non-inverting input of a current loop op amp. The use of these pins is referenced below but also well known and provided in the stated specification.

Output current is sensed in V-Sense Pin 5 by a resister branch 138 connected to both the output 140 and the common ground 41. Output voltage is sensed in V-CTRL Pin 1 via the resistive divider branch 92.

In addition, Out Pin 3 and V-Sense Pin 5 are connected to a feedback loop 142 configured with the same filtering electronics as feedback loop 128. That is, the capacitor/resister branch 130 and capacitor branch 91 are swapped in order, but this swapping is semantics because the voltage across each branch is the same. The purpose is the same for these electronics as with loop 128, to provide proper timing and phase characteristics for the required feedback.

The feedback loop 142 is connected to a gate transistor 144 via a current passing resistor 146 connected to the transistor base. The branch having the transistor 146 includes a resistive divider 148 on its collector side. The resistive divider 148 is connected to the feedback loop 128 in the same way the resistive divider branch 92 is connected to the feedback loop 128 in the embodiment illustrated in FIG. 11. On the other hand, the transistor emitter side of the branch is connected to the output of the regulator 126 for supplying voltage therefrom to the gate.

In this embodiment, the error feedback loop 128 in the primary regulating controller 40 is connected to the output of the regulator 126 via a resistor branch 132. The extra resistor branch 132 provides power to the feedback loop when the transistor is turned off. This power is mostly needed to initially turn on the driver electronics under design requirements of the control chip.

Finally, Vcc Pin 6 for the sensing controller 136 is connected to the output side of the regulator 126 and is thereby powered. I-CTRL Pin 4 and GND Pin 2 are grounded to the driver common ground 41.

In use, when either over-voltage on V-CTRL Pin 1 or over-current on V-SENSE Pin 5 is sensed in the sensing controller 136, the transistor 144 is conducting, enabling a control signal to be sensed at Inv Pin 1 of the regulating controller 40. The regulating controller 40 will then modify the output voltage, by controlling the booster electronics, until the over-voltage or over-current goes to zero. The gate then opens and the control signal transmission ends. At this time, the modification of the voltage in response to the over current/over voltage ends.

The over-current/over-voltage sensing electronics and the voltage regulating electronics in FIG. 12, together, provide a more exacting result when seeking to deliver an essentially constant current to the multi-die LED array. The additional electronics are more responsive than the regulating controller 40, which judges the current only with the sensing resistor at CS Pin 4.

Accordingly, exemplary lighting systems have been disclosed, including a multi-die LED array and LED driver electronics. The driver electronics include voltage regulating electronics, which regulate rectified low voltage AC. The voltage regulating electronics include booster electronics that sense rectified low voltage AC and boost the LVAC to a predetermined voltage for powering the multi-die LED. The voltage regulating electronics further include power factor correcting electronics that sense the AC current and AC voltage in the driver and control the booster electronics to further regulate the voltage, thereby providing power factor correction. In addition, the voltage regulating electronics include constant current electronics which sense one or both of current and voltage through the driver and control the booster electronics to further regulate the voltage, thereby providing substantially constant current to the multi-die LED array.

Figure 13:
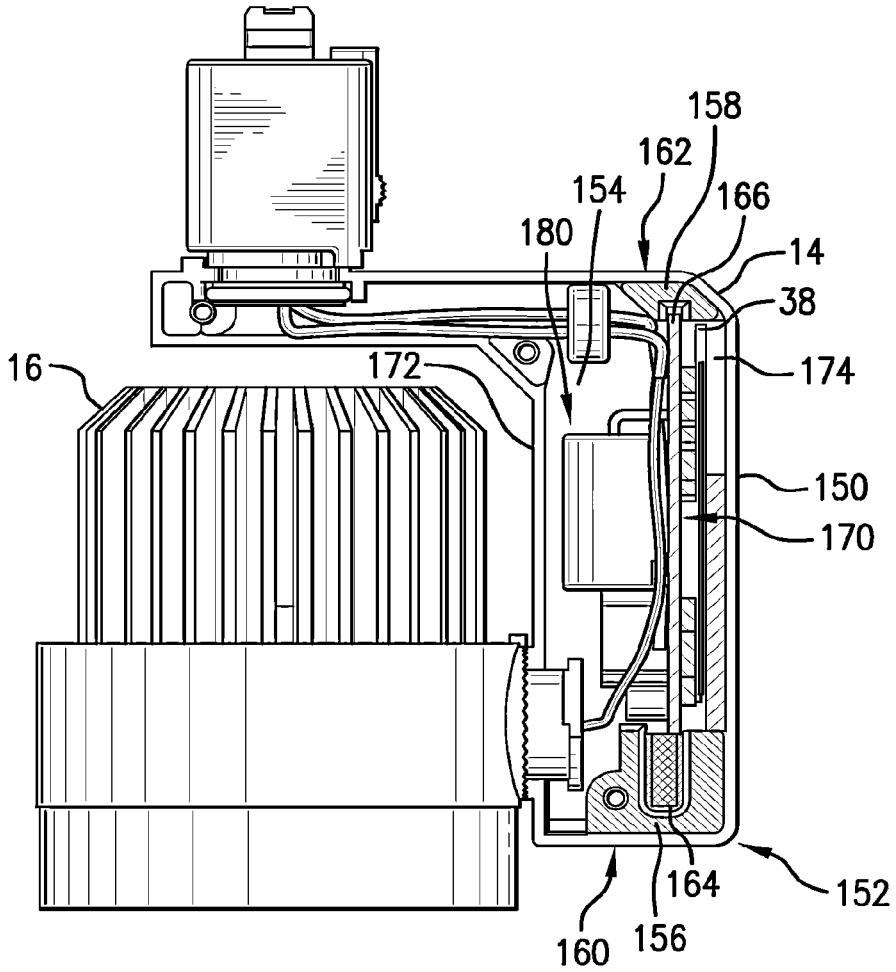
FIGS. 13-15 illustrate the ballast box according to an embodiment of the invention.
Figure 14:
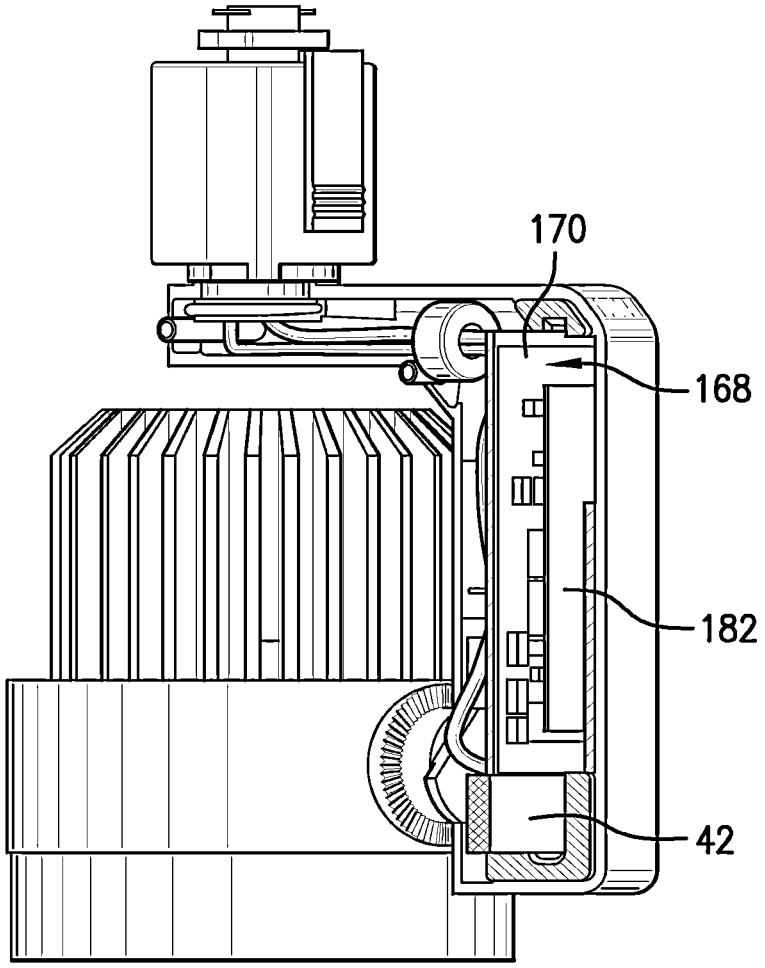
Figure 15:
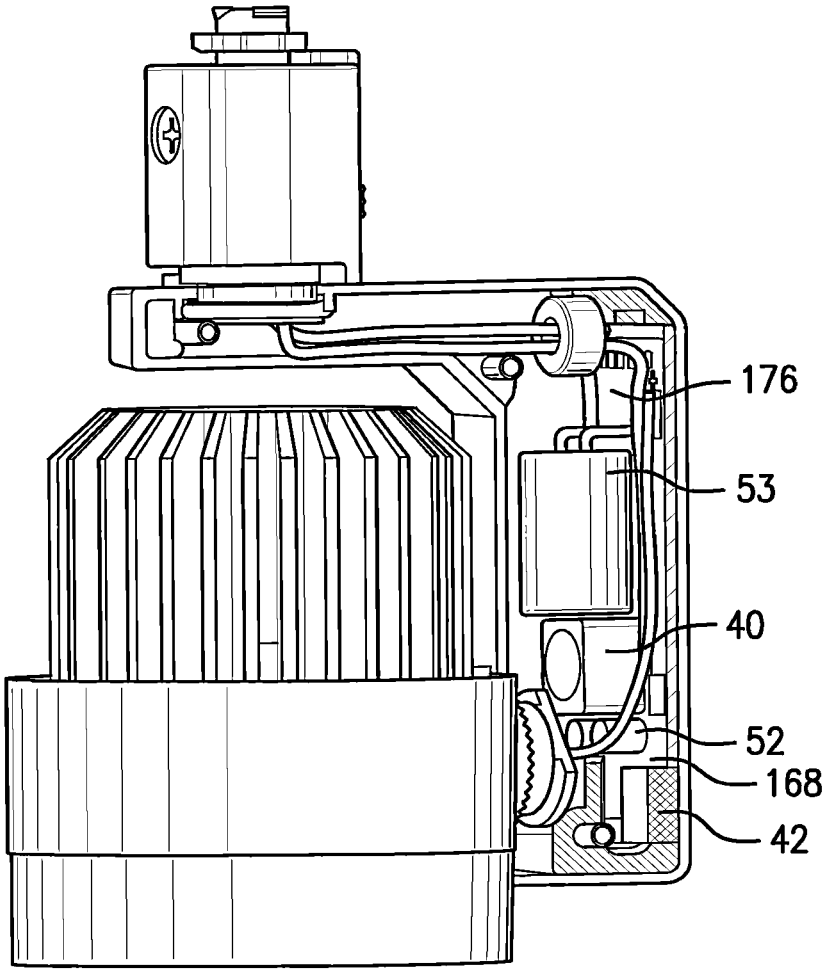

Turning back to the configuration of the Fixture 10, and as further illustrated in FIGS. 13-15, in an alternative embodiment, the ballast box 14 is made of a material having high heat transfer qualities, such as aluminum. The underside of the box 150 is formed to be positioned against the bottom of the components of the driver 38 which become heated during operation. Components which generate significant heat include the rectifying diodes and the switching transistor. As such, the heat is drawn to the outside of the ballast box 14 and emitted to the atmosphere. This heat transfer mechanism keeps the driver electronics relatively cool, preventing long term damage.

More specifically, as illustrated in FIGS. 13-15 the driver ballast box 14 is includes an exterior frame 152 and a driver storage chamber 154 therein. First 156 and second 158 opposing brackets are cast molded into the ballast box and are disposed at first 160 and second 162 opposing sides of the chamber 154 for holding first 164 and second 166 opposing ends of a driver PCB 168. In the illustration, an electrically isolating, heat transfer pad encases the first end 164 of the driver, to protect components at that end. In the illustration, no such pad is required at the opposing end because the PCB board directly fits within the related bracket.

With this configuration, a bottom side 170 of the PCB 168 faces the bottom of the chamber, that is, the bottom of the box 150 with a first space 174 therebetween, and a top side 176 of the PCB 168 faces the top 172 of the chamber with a second space 180 therebetween.

With the disclosed ballast box, the first 156 bracket transfers heat to the exterior frame 152 of the ballast box 14 at the first side 160 of the chamber 154, and the second 158 bracket transfers heat to the exterior frame 152 of the ballast box 14 at the second side 162 of the chamber 154. As further illustrated on the left side of the space 174 as illustrated in the Figure, between the bottom side 170 of the PCB 168 and the bottom of the chamber 150, and additional component seat is cast into the ballast box. The seat forms a base heat transfer material which transfers heat into the bottom of the chamber 150 from, for example, the switching transistor.

In addition, the space 174 between the bottom side 170 of the PCB 168 and the bottom of the chamber 150 includes additional base heat transfer material 182. The material, again, is a typical electrically isolating heat transfer pad, for protecting the switching transistor. The heat transfer material 182 transfers heat absorbed from the transistor to the bottom of the chamber 150, and into the integrally cast seat, thereby to the exterior frame 152 of the ballast box 14.

In one embodiment, the additional base heat transfer material 182 is a gel. Alternatively, the additional base heat transfer 182 material is a conductive rigid heat transfer material. Additionally, one or more of the first bracket 156, the second bracket 158 and the base heat transfer material can be formed separately from and connected to the exterior frame 152 of the ballast box 14, as compared with being a unitary cast design.

The benefit of this configuration is maintaining proper operational temperatures for the driver. Otherwise, the driver would quickly overheat in the small space provided by the driver storage chamber 154.

The disclosed embodiments may be configured in other specific forms without departing from the spirit or essential characteristics identified herein. The embodiments are in all respects only as illustrative and not as restrictive. The scope of the embodiments is, therefore, indicated by the appended claims and their combination in whole or in part rather than by the foregoing description. All changes that come within the meaning and range of equivalency of the claims are to be embraced within their scope.

What is claimed is:

1. A lighting system comprising:

a multi-die LED array;

LED driver electronics, configured to generate heat, which include voltage regulating electronics, wherein the voltage regulating electronics regulate rectified low voltage AC;

a driver housing, having high heat transfer qualities and adjacent to the bottom of the LED driver electronics, wherein the driver housing is configured to draw and release heat from the LED driver electronics; and a heat sink, secured to the multi-die LED array and connected to the driver housing;

the regulating electronics comprising:

booster electronics that receives 12 V nominal AC voltage and boost the low voltage AC to a predetermined voltage which is output to the multi-die LED through an isolation transformer;

power factor correcting electronics, configured to manipulate driver output voltage, that sense the AC voltage in the driver and control the booster electronics to further regulate the input current, thereby providing power factor correction; and constant current electronics which sense one or both of AC current and AC voltage through the driver and control the booster electronics to further regulate the voltage by reducing any over-voltage to zero, thereby providing substantially constant current to the multi-die LED array regardless of load voltage variation;

wherein the voltage output from the boost electronics that is output to the multi-die LED array is also fed to and drives the constant current electronics.

2. The system of claim 1 wherein the driver comprises filtering electronics which filter the rectified voltage that is thereafter regulated by the voltage regulating electronics.

3. The system of claim 2, where the filtering electronics are disposed upstream of the voltage regulating electronics and downstream of the rectifying electronics.

4. The system of claim 2, where the upstream filtering electronics are parallel with the rectifying electronics.

5. The system of claim 1, where the booster electronics include an inductor that receives the rectified AC voltage, a diode electrically connected to the load, and a common grounded branch which includes a switch.

6. The system of claim 5, where:

the common grounded branch includes a current sensing resistor; and the driver includes a controller which senses current through the current sensing resistor and operates the switch;

thereby boosting voltage to the load.

7. The system of claim 6, where the driver includes voltage sensing electronics sensing voltage on an input side of the driver and on an output side of the driver, and communicating input and output voltage to the controller.

8. The system of claim 7, where the voltage sensing electronics include an input-side resistive divider and an output-side resistive divider, each in electronic communication with the controller.

9. The system of claim 6, where the power factor correction electronics include the controller which senses voltage in the driver and current passing through the driver and controls the switch to further regulate the voltage, thereby providing power factor correction.

10. The system of claim 6, where the constant current electronics include the controller which senses current passing through the driver and controls the switch to further regulate voltage, thereby supplying the load with substantially constant current.

11. The system of claim 6, where the controller is a voltage regulating controller and the driver includes a sensing controller that senses both current and voltage at the load, and electrically transmits a control signal to the regulating controller upon sensing over-voltage or over-current, and the voltage regulating controller responds by further regulating voltage, thereby supplying the load with substantially constant current.

12. The system of claim 11, where the sensing controller controls a second switch so as to close the second switch upon sensing over-voltage or over-current, whereby the control signal is transmitted to the voltage regulating controller.

13. The system of claim 12, including a first output-side resistive divider connected to the load through which the sensing controller senses voltage at the load, and the regulating electronics include a second resistive divider, connected to an output side of the second switch, through which the control signal from the sensing controller are transmitted.

14. The system of claim 6, further comprising a linear voltage regulator disposed downstream of the controller, that reduces the boosted voltage for powering the controller.

15. The system of claim 14, wherein output of the voltage regulator powers the regulating electronics.

16. A method of lighting a multi-die LED array, comprising:

transmitting power through LED driver electronics, configured to generate heat, which includes voltage regulating electronics, wherein the voltage regulating electronics regulate rectified low voltage AC; and drawing and release, by a driver housing and a heat sink connected thereto and secured to the multi-die LED array, heat from the LED driver electronics, the driver housing having high heat transfer qualities and being adjacent to the bottom of the LED driver electronics;

wherein the regulating electronics comprises:

booster electronics that perform the steps of receiving 12 V nominal AC voltage and boosting the low voltage AC to a predetermined DC voltage which is output to the multi-die LED through an isolation transformer, power factor correcting electronics, configured to manipulate driver output voltage, that perform the steps of sensing the AC current and AC voltage in the driver and controlling the booster electronics to regulate the voltage, thereby providing power factor correction; and constant current electronics that perform the steps of sensing one or both of AC current and AC voltage through the driver and controlling the booster electronics to further regulate the voltage by reducing any over-voltage to zero, thereby providing substantially constant current to the multi-die LED arrays regardless of load voltage variation;

wherein the voltage output from the boost electronics that is output to the multi-die LED array is also fed to and drives the constant current electronics.

* * * * *